US005913696A

United States Patent [19]

Chen

[11] Patent Number: 5,913,696

[45] Date of Patent: Jun. 22, 1999

[54] WATER-PROOF STRUCTURE OF A LAMP BASE

[76] Inventor: Ching Chao Chen, No. 511, Sec. 3, Ton-Da Rd., Hsin-Chu City, Taiwan

[21] Appl. No.: 08/990,527

[22] Filed: Dec. 15, 1997

[51] Int. Cl.[6] ..... H01R 4/24

[52] U.S. Cl. ..... 439/419; 439/602

[58] Field of Search ..... 439/419, 602

[56] References Cited

U.S. PATENT DOCUMENTS 5,722,853 3/1998 Hwang ..... 439/419

FOREIGN PATENT DOCUMENTS 95228728 12/1996 China .

*Primary Examiner*—Gary Paumen
*Assistant Examiner*—Antoine Ngandjui
*Attorney, Agent, or Firm*—Harold L. Novick; Nath & Associates

[57] ABSTRACT

The present invention is related to a water-proof pad of a lamp base comprises a lamp base and a water-proof pad, wherein the through hole is installed aside the lower seat of the lamp base and said water-proof pad has a cylindrical portion and a plane plate which are formed integrally. Said water-proof pad may pass through said through hole so that the cylindrical portion and the plane plate may be assembled on the upper and lower ends of a positive polarity conducting piece, respectively, then as the lamp is assembled on a predetermined position of the lamp base, the water-proof effect of the contact piece of the positive polarity conducting piece is achieved.

9 Claims, 3 Drawing Sheets

WATER-PROOF STRUCTURE OF A LAMP BASE

BACKGROUND OF THE INVENTION

1. Field of the Invention

The present invention is related to a water-proof structure of a Christmas lamp, especially to a water-proof pad which is formed integrally, thus the water-proof effect of positive polarity conducting piece is achieved.

2. Description of the Prior Art

In general, a serial of Christmas lamps includes lamp bases and lamps assembled on one ends of the lamp bases. If the lamps are used outdoors in order to prevent the rain to permeat into the lamp bases through the assembled interface between the lamps and the lamp base, thus American UL has defined a related standard.

In order to match said American UL standard, the China Patent Application 95228728.5 has disclosed a water-proof structure of a lamp base, in which a rubber water-proof ring is installed between the upper end of the lamp base and the lamp and a ring shape water-proof pad is installed between the lower end of the lamp base and contacting surface of an engaging plate. By the tightly enforcing of the rubber water-proof ring and the ring shape water-proof pad, the outside rain water will not flow into the lamp base.

However, in the structure of aforementioned patent application, the assembling interface of the water-proof ring between the inner rim of the upper end of the lamp base and the lamp need higher assembling precision. If the precision is insufficient or deformed, it is often that the lamp will not be assembled on a set position of said lamp base, i.e. the contact copper head on the lower end of the lamp will not contact with the positive polarity conducting piece.

Further, the shape of said water-proof pad is not the same as that the electric line radially passing through the lower end of the lamp base and the engaging plate, while the rain water will still has the probability to flow into the lamp base through the gap between the water-proof pad and the electric line. Thus in the patent application, a water-proof block is needed to further cover the conducting piece so to prevent the probable permeation.

From the structure of said patent application, in order to achieve the object of water-proof, three independent elements, a water-proof ring, a water-proof pad and a water-proof block, are included. Thus it has further increased the costs of fabrication and assembly.

SUMMARY OF THE INVENTION

Accordingly, the present invention is provided a water-proof pad of a lamp base comprises of a lamp base and a water-proof pad, wherein a through hole is installed aside the lower seat of the lamp base and said water-proof pad has a cylindrical portion and a plane plate which are formed integrally. Said water-proof pad may pass through said through hole so that the cylindrical portion and the plane plate may be assembled on the upper and lower ends of a positive polarity conducting piece, respectively, then as the lamp is assembled on a predetermined position of the lamp base, the water-proof effect of the contact piece of the positive polarity conducting piece is achieved.

Further, in the water-proof pad enclosed the upper and lower ends of the positive polarity conducting piece, the cylindrical portion and the plane plate are formed integrally, thus the costs of fabrication and assembly are saved.

The present invention will be better understood and its numerous objects and advantages will become apparent to those skilled in the art by referencing to the following drawings in which:

DETAILED DESCRIPTION OF THE PREFERRED EMBODIMENT

Figure 1:
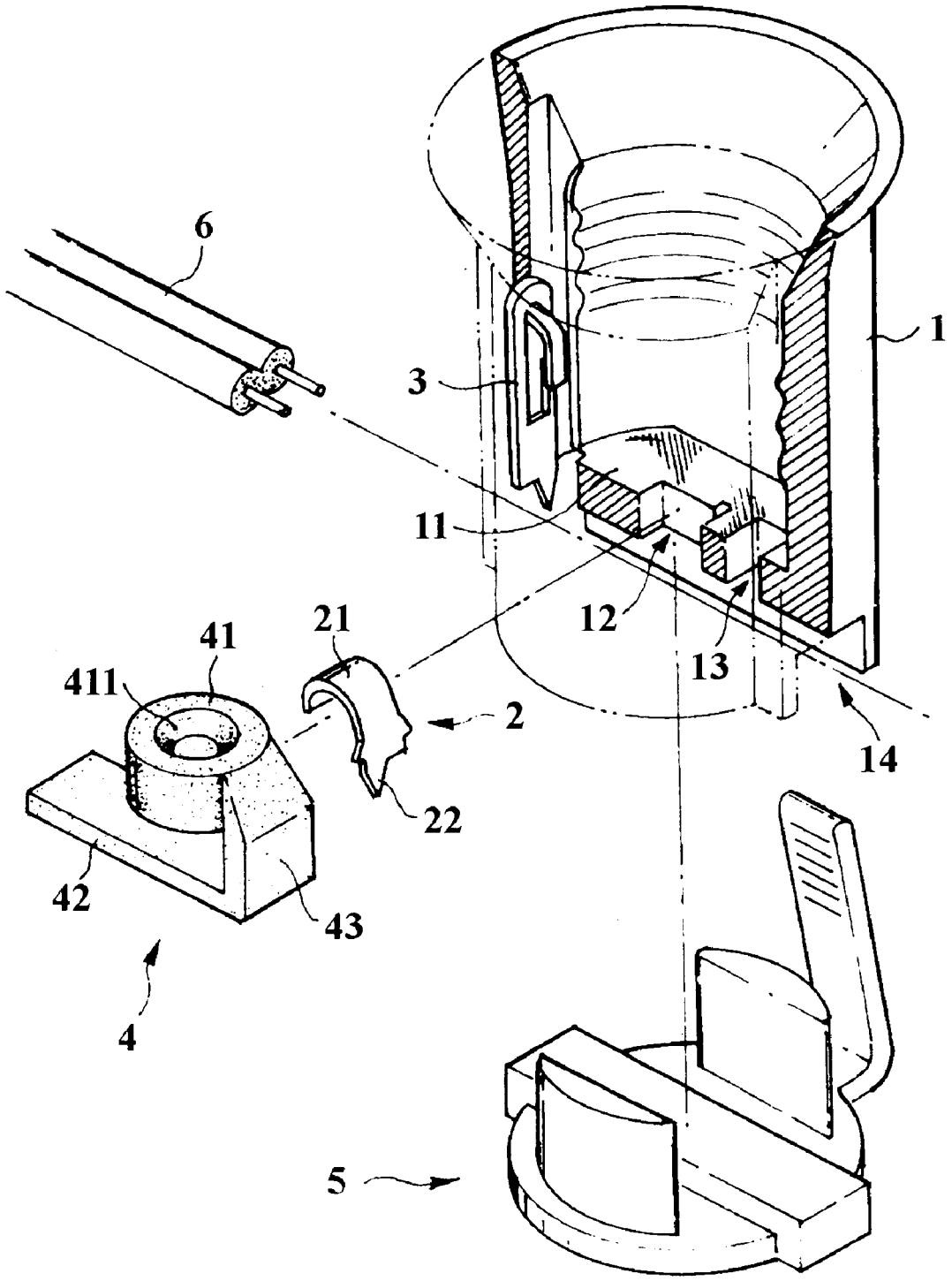
FIG. 1 is a perspective view of the present invention.
Figure 2:
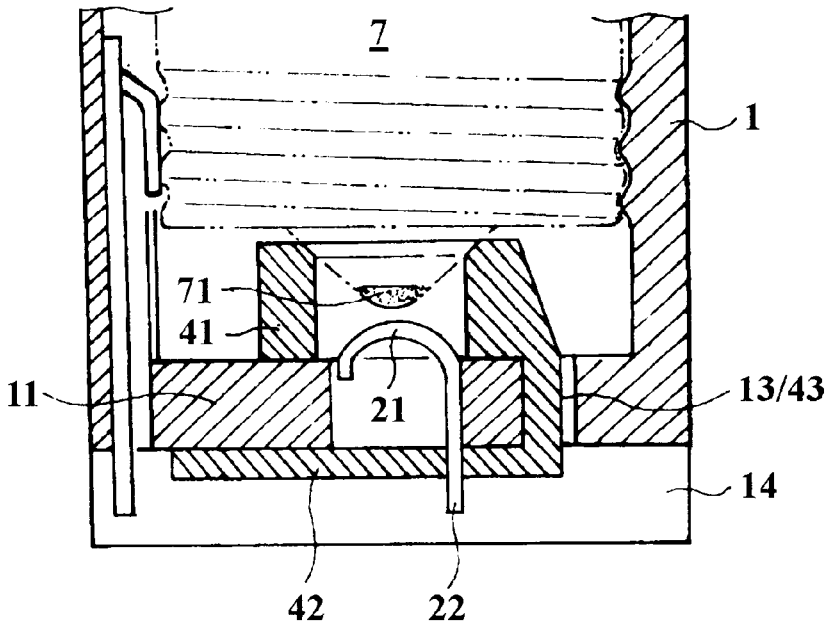
FIG. 2 is a front cross sectional view of FIG. 1 which shows the respective position of the water-proof pad and the other components.

Referring now to FIGS. 1 and 2, the water-proof structure of a lamp base of the present invention includes a lamp base (1) and a water-proof pad (4), wherein the lamp base (1) has a cylindrical shape, and a seat (11) is formed on the lower end of said lamp base (1). While an engaging hole (12) is installed on the center portion of the seat (11) and a through hole (13) is installed on one side of the engaging hole (12). Additionally, a groove (14) with the same radius direction as that of the seat (11) is formed between the lower side of the seat (11) and the lamp base (1).

Said engaging hole (12) is employed for engaging with a positive conducting piece (2) and a cambered contacting end (21) are formed on the upper end of the positive polarity conducting piece (2). The contact end (21) is projected on a proper height above the seat (11). As for the lower end of the positive polarity conducting piece (2) a tip penetrating end (22) is installed thereon, while said penetrating end (22) is penetrated downwards on said groove (14) with a proper height.

A water-proof pad (4) is installed, which is made from an elastic body as plastic material. The water-proof pad (4) includes a cylindric portion (41) positioned on the contacting end of the positive polarity conducting piece (2) and a plane plate (42) positioned on the groove. (14). Said contact end (21) of said positive polarity conducting piece is enclosed by an axial circular hole (411) of the cylindrical portion (41).

Alternatively, a connecting portion (43) is installed on said water-proof pad (4) for connecting said cylindrical portion (41) with said plane plate (42), i.e. the water-proof pad (4) may be formed integrally.

Figure 3:
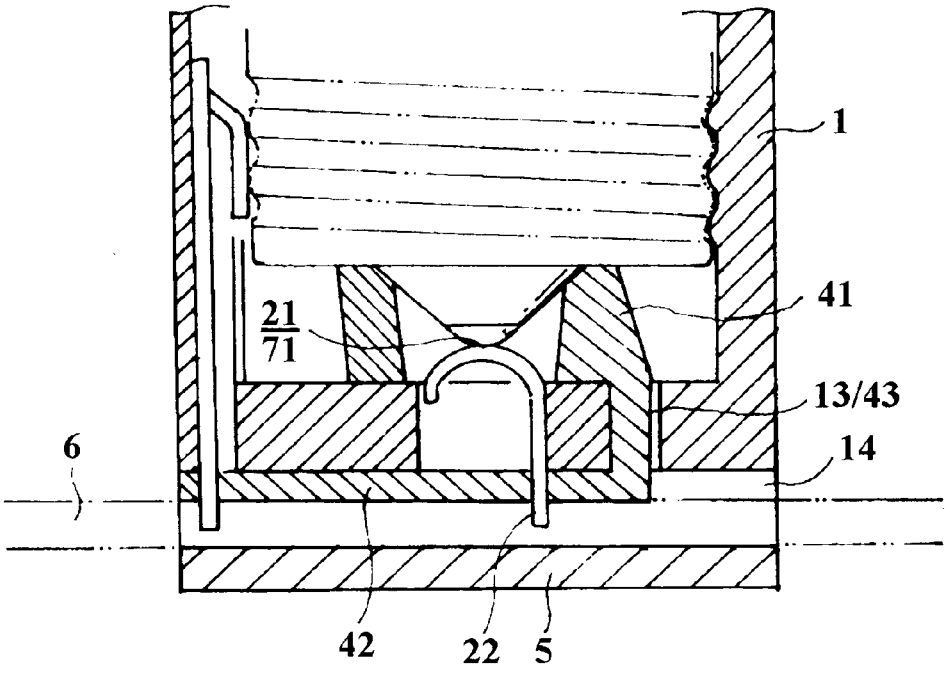
FIG. 3 is a schematic view shown as the lamp is screwed on a predetermined position of the lamp base, the water-proof pad is compressed.

By the design of the lamp base (1) and the water-proof pad (4), the water-proof pad (4) may pass through said through hole (13) so that the cylindrical portion (41) and the plane plate (42) may be assembled on the upper and lower ends of said positive polarity conducting piece (2), as shown in FIG. 3. Then when the lamp (7) is shrewdly engaged with the lamp base (1) for positioning, the contact copper head (71) under the lamp (7) will enter into the axial hole (411) of the cylindrical portion (41). Therefore, the object of tightly enforcing the cylindrical portion (41) is achieved. Thus the copper head (71) of said lamp (7) is wholly tightly enclosed by said cylindrical portion (41) so to prevent the entering of rain water.

When the contact member (5) is assembled under the seat (11), the contact member engaging hole (5) will press the plane plate (42) of the electric line (6) and the water-proof pad (4), then the penetrating end (22) of the positive polarity conducting piece (2) will penetrating through the insulators of the plane plate (42) and the electric line (6), so that the penetrating end will contact with the central line of the electric line (6). Since said plane plate (42) and said electric line (6) are all elastic body, thus during tightly enforcing, the rain water will not drain into the contact area between the central line of the electric line (6) and the penetrating end (22) or the interface between plane portion (42) and the lower end of the seat (42), therefore, the object of water proof achieved.

Since longitudinal negative polarity conducting piece (3) is installed on the inner rim of the wall of the buckling groove, wherein the inner rim of wall of buckling groove is defined as the connection of the ground line of the electric line (6). Thus, the water-proof pad of the present invention (4) is only needed to seal the conducting piece (2) of said positive polarity so to prevent the danger of electric contact.

Since said water-proof pad (4) had a C shape, it may be inconvenient that for assembling the water-proof pad (4) with said lamp base (1). In order to solve said trouble, the connection portion (43) of said water-proof pad (4) may be canceled, i.e. the cylindrical portion (41) and the plane plate (42) are independent elements and are combined on predetermined positions of the seat (11) and groove (14), and by the enforcing of the lamp (7) and the engaging hole (5), said effect may achieved.

Figure 4:
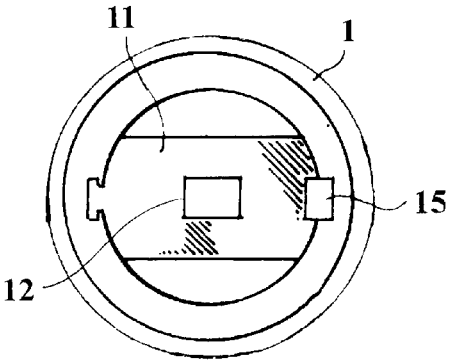
FIGS. 4 and 5 are a modified embodiment of the lamp base.
Figure 5:
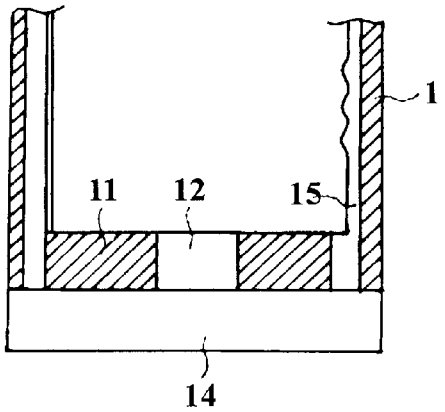
Figure 6:
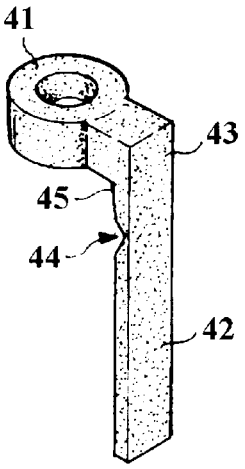
FIG. 6 is a modified embodiment matching the water-proof pad of the lamp base in FIGS. 4 and 5.

Furthermore, a modified embodiment is also disclosed in the present invention. As shown FIGS. 4 and 6, a longitudinal groove (15) is formed on the inner rim of the lamp base (1), which is penetrated through the seat (11), as shown in FIG. 5.

Moreover, said water-proof pad (4) and said plane plate (42) is longitudinal extended from the connection portion (43), and a bent portion (44) with a chamfered corner is formed between said connection (43) and the plane plate (42).

Figure 7:
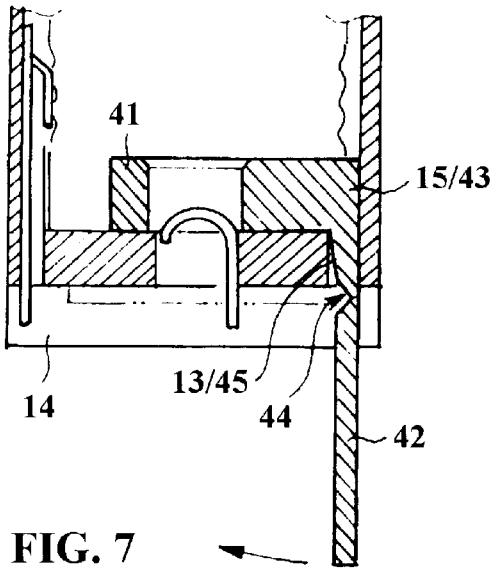
FIG. 7 is an assembled schematic view of the water-proof pad in FIG. 6 and the lamp base in FIG. 5.

The width between the connection portion (43) and the plane plate (42) is correspondent to that of the longitudinal groove (15) of the lamp base (1), thus said water-proof pad (4) and said plane plate (42) may be pushed forwards along the orientation of the slot on the longitudinal groove (15) so that the plane plate (42) will pass through the seat (11) to a predetermined position as shown in FIG. 7.

Next, before performing the combination of the contact member (5) with said lamp base (1), the operator may firstly move the longitudinal plane plate (42) to a transversal position, then when the contact member (5) is assembled in a predetermined position, similarly, the contact member (5) may enforce the electric line (6) and the plane plate (42) to a assembled condition as shown in FIG. 3.

Since the plane plate (42) is formed as the predetermined position as shown in FIG. 3, it is possible that the cylindrical portion (41) may be curled outwards according to the elasticity of the material. Therefore, the connection portion of the water-proof pad (4) is set to resist against said longitudinal groove (15) so that the cylindrical portion (41) is supported and held in a predetermined position.

In order to further confine the curled phenomenon that probably occurred on said cylindrical portion (41). A inclined surface (45) may be formed on the connection portion (43) within the range of the through hole (13) of the seat, thus as the water-proof pad (4) is assembled in a predetermined position, the inclined surface (45) will tightly enforce on the position of the through hole (13), in consequence, the cylindrical portion (41) is well positioned.

Although certain preferred embodiment of the present invention has been shown and described in detail, it should be understood that various changes and modification may be made therein without departing from the scope of the appended claims.

What is claimed is:

1. In combination, a lamp base and a separate water-proof structure contained within said lamp base, said lamp base having a groove portion therein, and said water-proof structure comprising a water-proof pad, the water-proof pad including a cylindrical portion having an axial hole therein and a plane plate, the cylindrical portion being positioned on the upper end of a seat, said seat being formed as part of the lamp base; a positive polarity conducting piece having a contact end, and said contact end of said positive polarity conducting piece being enclosed by said axial hole when said plane plate is assembled on the groove portion of said lamp base.

2. The combination as claimed in claim 1, wherein the seat of the lamp base further includes a through hole.

3. The combination as claimed in claim 1, wherein the cylindrical portion of the water-proof pad and the plane plate of the water-proof pad are connected together by a connection portion.

4. The combination as claimed in claim 3 wherein the seat of the lamp base includes a through hole and wherein the connection portion of the water-proof pad is located in the through hole.

5. The combination as claimed in claim 3 wherein the lamp base includes an inner rim wall and wherein a longitudinal groove penetrating the seat is formed on the inner rim wall of the lamp base.

6. The combination as claimed in claim 3 wherein the plane plate of the water-proof pad extends longitudinally from said connection portion, and a bent portion with chamfered shape is formed between the connection portion and the plane plate.

7. The combination as claimed in claim 5, wherein the width of each one of said connection portion and plane plate corresponds to that of the longitudinal groove of said lamp base.

8. The combination as claimed in claim 6, wherein the seat of the lamp base includes a through hole and wherein an inclined surface is formed on the connection portion within the range of the through hole on the seat.

9. The combination as claimed in claim 6, wherein the width of each one of said connection portion and said plane plate corresponds to that of the longitudinal groove of said lamp base.

* * * * *